United States Patent [19]

Kang

[11] Patent Number: 4,893,610

[45] Date of Patent: Jan. 16, 1990

[54] LIQUEFIED PETROLEUM GAS AND ELECTRIC WATER HEATER

[76] Inventor: Jong K. Kang, 393-1 Daga-Dong, Cheonan-Si, Choongnam-Do, Rep. of Korea

[21] Appl. No.: 359,693

[22] Filed: May 31, 1989

[51] Int. Cl.[4] ..... F24C 5/04

[52] U.S. Cl. ..... 126/360 R; 126/361; 122/13 R

[58] Field of Search ..... 126/360 R, 360 A, 361, 126/364, 374; 122/13 R, 13 A, 14

[56] References Cited

U.S. PATENT DOCUMENTS 1,166,411 12/1915 Davis ..... 126/360

2,092,139 9/1937 Ramer ..... 126/360

*Primary Examiner*—Carroll B. Dority

*Attorney, Agent, or Firm*—Birch, Stewart, Kolasch & Birch

[57] ABSTRACT

A liquefied petroleum gas (LPG) and electric water heater which includes a water tank, an electric heater and a separate LPG combustion chamber having a plurality of water conduits disposed within the water tank, a control box for changing the source of the heating fuels and sensors for sensing the water temperature whereby the LPG and electric water heater may select one of both LPG and electric power as a heat source.

8 Claims, 2 Drawing Sheets

LIQUEFIED PETROLEUM GAS AND ELECTRIC WATER HEATER

BACKGROUND OF THE INVENTION

1. Field of the Invention

The present invention relates to a liquefied petroleum gas (LPG) and electric water heater and more particularly to an improved LPG and electric water heater including a water tank a conical LPG combustion chamber having a plurality of water conduits therein and a separate electric heater within the water tank for providing alternative heating sources to heat the water in the water tank, a control box for converting the heating source for the operation of the water heater, and sensors for sensing the temperature of the water in the water tank, whereby the water heater may selectively use LPG or electric power for efficiently heating the water therein. For example, to start the water heater and use it in day time, LPG may be used, and for use at night time, an electric source may be used.

2. Description of the Prior Art

Several types of water heaters are known in the art and have a plurality of depressions therein. However, such water heaters require a fuel for heating the water therein, such as for example, coal, briquettes, kerosene, or gasoline. While such fuels are inexpensive compared with electric power, they cause problems such as pollution, toxication, and the like. On the other hand, while electric power is expensive, there are none above problems. Furthermore, since such water heaters have a water tank with a complex structure and are difficult to operate, such water heaters have proven to be unpractical for various purposes. Such water heaters are disclosed in Korean Utility Model Publication Nos. 71-1,368, 87-107, 87-2,741, and 87-1,688.

SUMMARY OF THE INVENTION

Accordingly, it is an object of the present invention to provide a liquefied petroleum gas (LPG) and electric water heater which may selectively use one of both of the water heating fuels LPG and electric power.

Another object of the present invention is to provide a water heater which includes a water tank and a conical combustion chamber having a plurality of water conduits for efficiently heating the water in the water tank.

A further object of the present invention is to provide an improved water heater which contains sensors for sensing a water temperature, gauge members for checking water temperature and water pressure, and a control box for easily converting the power source from LPG to electric power, or from electric power to LPG.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a liquefied petroleum gas (LPG) and electric water heater which includes a water tank, an electric heater and a separate LPG combustion chamber having a plurality of water conduits disposed within the water tank, and a control box and sensors for changing the use of the heating fuels and sensing the water temperature whereby the LPG and electric water heater may selectively use LPG or electric power as a power source.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
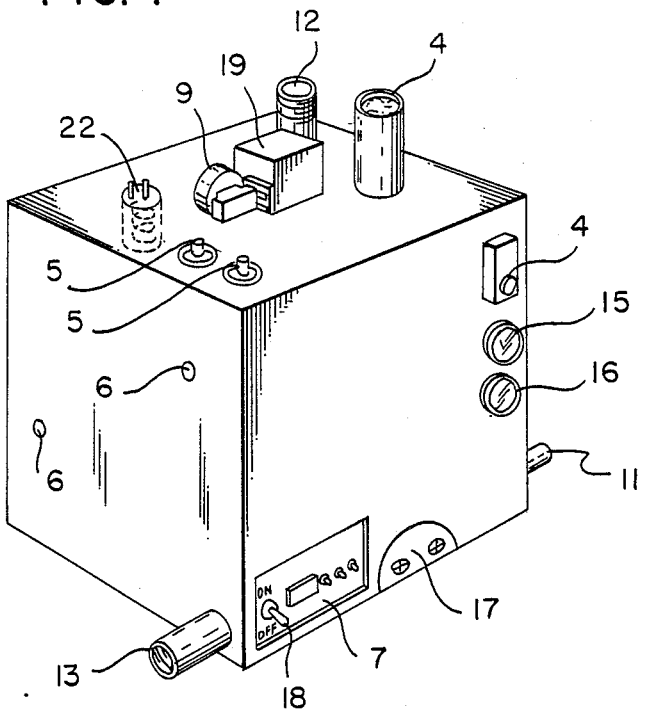
FIG. 1 is a perspective view of a liquefied petroleum gas (LPG) and electric water heater according to the present invention.
Figure 2:
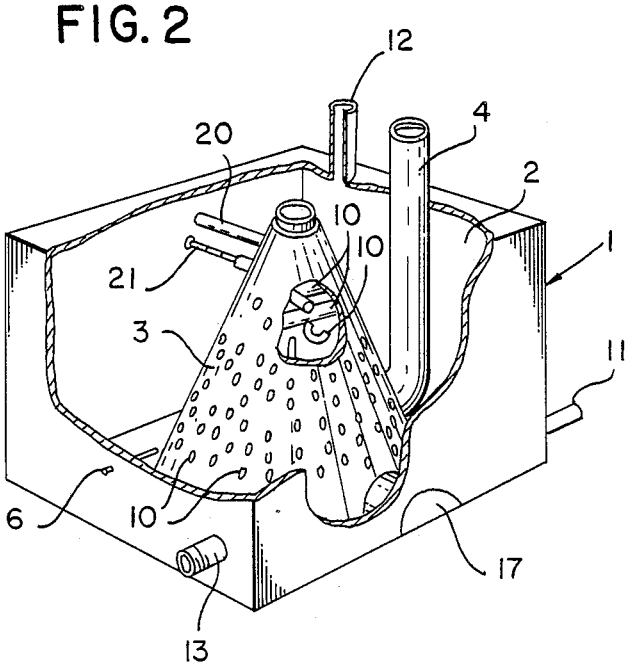
FIG. 2 is a perspective view of the water heater according to the present invention, showing in cut away portions thereof a conical combustion chamber having a plurality of water conduits.
Figure 4:
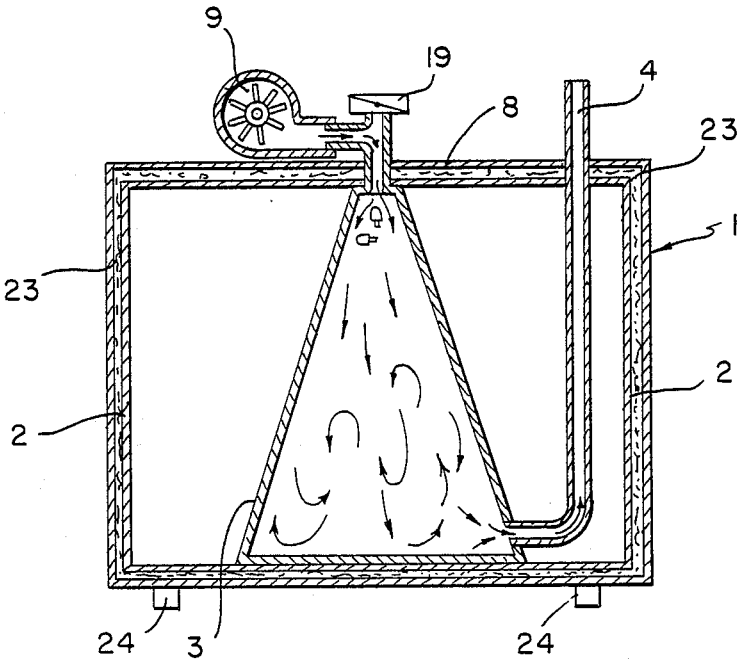
FIG. 4 is a sectional view of FIG. 1 showing the water tank with the conical combustion chamber therewithin.

Referring now in detail to the drawings for the purpose of illustrating preferred embodiments of the present invention, the liquefied petroleum gas (LPG) and electric water heater as shown in FIGS. 1, 2, and 4 comprises a water heater body 1, a water tank 2, a conical combustion chamber 3 containing a burner 8, an electric heater 22 disposed within the water tank 2, water temperature sensors 5, and a control box 7 for selecting the LPG or electric power to be used as a power source so as to heat the water in the water tank 2.

Figure 3:
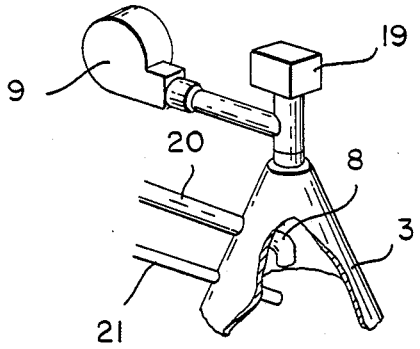
FIG. 3 is a perspective view of the LPG combustion chamber of the water heater according to the present invention, showing in cut away portions thereof a burner, a fan, and a flame checking member connected to the combustion chamber.

As shown in FIG. 3, the conical combustion chamber 3 contains the burner 8 disposed in the upper portion thereof for mating with a spark portion disposed at the end of an electric wire 21 so as to ignite the burner 8. The burner 8 is connected to a LPG inlet pipe 20. A fan 9 and a flame monitoring member 19 are positioned at the top of the conical combustion chamber 3 and operatively associated with the combustion chamber 3 for blowing the flame of a fire in the downstream direction and monitoring the fire flame condition. Therefore, the fire flame can be moved downward and exit out through a flue pipe 4 and the fire flame can be controlled by the fire monitoring member 19 (FIG. 4). The conical combustion chamber 3 contains a plurality of water conduits 10 for contacting the fire flame through the outer surface of the plurality of water conduits so as to uniformly heat the water in the water tank 2.

Insulation material 23 is positioned between the water heater body 1 and the water tank 2 for insulating the hot water in the water tank 2. The water heater body 1 is provided with a plurality of supports 24 disposed on the bottom thereof for supporting the water heater. Temperature sensors 5 are mounted to the top of the water heater body and connected to sensing wires 6, respectively, wherein the sensing wires 6 are disposed within the water tank 2. A predetermined temperature gauge 14 and a hot water temperature gauge 15, and a hot water pressure gauge 16 are mounted to the side wall of the water heater body 1. The control box 7 including an on/off switch 18 in the vicinity thereof selects one of the LPG and the electric power for heating the water in the water tank 2. The on/off switch 18 is connected to the electric wire 21 and connected to the electric heater 22 for supplying the electric power to them. An ash tray aperture 17 is located in the bottom of the water heater 1.

The water tank 2 is provided with a fresh water inlet pipe 11 and a recycled water collecting inlet 13 disposed at the lower portion of the water heater body 1. A hot water outlet 12 is disposed at the top of the water heater body 1 for supplying the hot water in the water tank 2 to an area to be heated (FIG. 1).

The liquefied petroleum gas (LPG) is a compressed petroleum gas or a liquefied hydrocarbon gas. A compressed or liquefied gas is obtained as a by-product in petroleum refining or natural gasoline manufacture, e.g., butane, isobutane, propane, propylene, butylenes, and their mixtures. LPG is colorless, noncorrosive, nontoxic, and has a flash point of −100° F. (−74° C.) and an autoignition temperature of 800°-1000° F. (426°-537° C.).

In operation, after the desired temperature for the water in the water tank 2 is set with the predetermined temperature gauge 14 by operating the control box 7 so as to utilize the LPG for the heating source of the water in the water tank 2, the burner 8 disposed within the combustion chamber 3 is ignited. Therefore, the water in the water tank 2 is uniformly heated through the plurality of water conduits 10. Then the fire flame may be controlled by the fire flame monitoring member 19 and is directed downward by the fan 9. The fire flame and any smoking are exhausted through the flue pipe 4. At this time, the temperature of the water in the water tank 2 meets the predetermined temperature of the predetermined temperature gauge 14 and the control box 7 causes the LPG supply from the LPG inlet 20 to stop.

When the temperature of the water in the water tank 2 decreases below about 10°-15° C. from the predetermined temperature, the control box 7 is actuated to supply the LPG in the LPG inlet 20. The operation of the mechanism of the present invention when using electric power is essentially similar to the description provided above with regard to the use of LPG. Generally, while the LPG may be used for operation to start the water heater or in the day time, and electric power may be used in the night time because the cost of the electric power is generally more expensive than that of the LPG.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A liquefied petroleum gas and electric water heater comprising:

a water heater body, a water tank disposed within said water heater body, said water tank including:

a conical combustion chamber, disposed therewithin containing a plurality of water conduits, said conical combustion chamber containing a burner disposed therewithin for exposing the flame from said burner to the outer surface of said plurality of water conduits so as to uniformly heat the water in the water tank, and a separate electric heater disposed therewithin, a control box associated with said burner in the conical combustion chamber and said separate electric heater for selecting as a heat source the burner or the electric heater so as to efficiently, economically heat the water in the water tank, said control box being provided with an on/off switch connected to an ignition spark for said burner and being electrically connected to said electric heater, means for sensing the temperature of the water in the water tank, and means for monitoring the temperature, the pressure, and the flame of the water heater.

2. The water heater of claim 1, wherein the water heater body is provided with a predetermined temperature gauge disposed on the side wall thereof, a fresh water inlet and, a recycled water collecting inlet disposed at the lower portion thereof, respectively, a hot water supplying pipe and a flue pipe extending to said conical combustion chamber disposed at the top thereof, respectively, and a plurality of supports disposed on the bottom thereof for supporting the water heater.

3. The water heater of claim 1, wherein the burner is connected to a LPG supply pipe which is provided with said ignition spark in the vicinity thereof in said combustion chamber.

4. The water heater of claim 2, wherein the combustion chamber is operatively associated with a fan disposed at the top thereof for blowing the fire flame downward so as to uniformly distribute it to the inner surface of the combustion chamber.

5. The water heater of claim 1, wherein the combustion chamber is provided with an ash tray aperture disposed in the bottom thereof for collecting ash to be removed therefrom.

6. The water heater of claim 1, wherein the control box is associated with said predetermined temperature gauge for actuating the water heater below about 10°-15° C. from the predetermined temperature.

7. The water heater of claim 1, wherein the means for sensing temperature is provided with a plurality of sensing wires disposed within said water tank.

8. The water heater of claim 4, wherein the means for monitoring is provided with a fire flame monitoring member associated with said combustion chamber and disposed at the top of said water heater body and disposed in the vicinity of said fan, and a hot water temperature gauge and a hot water pressure gauge disposed on the side wall of said water heater body and disposed in the vicinity of said predetermined temperature gauge.

* * * * *